US009682792B2

(12) United States Patent
Shoff et al.

(10) Patent No.: US 9,682,792 B2
(45) Date of Patent: Jun. 20, 2017

(54) TRIANGULAR SHIPPING CONTAINER

(71) Applicant: ART.COM, INC., Emeryville, CA (US)

(72) Inventors: Warren Lee Shoff, Canal Winchester, OH (US); Steven Mathew Farmer, Reynoldsburg, OH (US); Brett Raymond Stone, Canal Winchester, OH (US)

(73) Assignee: ART.COM, INC., Emeryville, CA (US)

( * ) Notice: Subject to any disclaimer, the term of this patent is extended or adjusted under 35 U.S.C. 154(b) by 0 days.

(21) Appl. No.: 14/789,865

(22) Filed: Jul. 1, 2015

(65) Prior Publication Data

US 2017/0001749 A1 Jan. 5, 2017

(51) Int. Cl.

*B65D 5/02* (2006.01)
*B65D 5/42* (2006.01)
*B65D 5/04* (2006.01)

(52) U.S. Cl.

CPC ..... *B65D 5/029* (2013.01); *B65D 5/04* (2013.01); *B65D 5/4266* (2013.01)

(58) Field of Classification Search

CPC ..... B65D 5/04; B65D 5/4266; B65D 5/008; B65D 5/029; B65D 5/2042; B65D 5/2061
USPC ..... 229/115, 112; 493/153, 183; 53/461
See application file for complete search history.

(56) References Cited

U.S. PATENT DOCUMENTS

| | | | | | |
|---|---|---|---|---|---|
| 2,349,589 | A * | 5/1944 | Harrington | B65D 5/2042 | 229/115 |
| 3,482,760 | A * | 12/1969 | Boehm | B65D 5/0254 | 229/115 |
| 4,202,485 | A * | 5/1980 | Fremion | B65D 5/02 | 206/395 |
| 7,500,594 | B1 * | 3/2009 | Toth | B65D 5/061 | 229/137 |
| 7,699,211 | B2 | 4/2010 | Holloway | | |
| 2007/0000979 | A1 * | 1/2007 | West | B65D 5/029 | 229/115 |

* cited by examiner

*Primary Examiner* — Christopher Demeree
(74) *Attorney, Agent, or Firm* — Perkins Coie LLP

(57) ABSTRACT

Disclosure is directed to a preconfigured planar container template ("container template") that can be assembled into a triangular shipping container ("container"). The container template is a substantially planar panel/flat sheet having a specified number of fold lines at specified positions in the planar panel, and which can be assembled into the container by folding at the fold lines. While not only assembling the container template into the container is very easy, making or manufacturing the container template is also very easy. The making or the manufacturing of the container template can include cutting a planar panel, e.g., made of some preferable material, into a container template of a specified shape and size and making a specified number of fold lines on the container template. The container template can be manufactured without using any securing products, such as glue and staple.

22 Claims, 13 Drawing Sheets

TRIANGULAR SHIPPING CONTAINER

BACKGROUND

Cylindrical or tube containers for shipping items such as art items are known in the art. While they facilitate shipping art items, they are less convenient to handle, e.g., they tend to roll off the conveyor belts, in the shipping vehicles, which make them more prone to accidental damages. The cylindrical containers also consume more storage space, thereby increasing storage costs. Further, they also cost more to manufacture.

Some containers, such as triangular shipping containers, have been used to overcome the problems associated with a tube container. For example, the triangular containers have flat bottoms, and therefore do not roll away from their position like the tube containers do. Further, to conserve space and simplify handling, such containers are themselves typically shipped and stored in the form of unassembled templates that must be folded and glued, taped, and/or stapled to produce complete, assembled containers. Assembly of a container often requires numerous portions of the template to be folded and fastened together, which can be time consuming and labor intensive. Further, the container templates used for being assembled into the triangular shipping containers use various securing products such as glue. Using such securing products to make the container template can increase the manufacturing costs and the time required for manufacturing such templates.

BRIEF DESCRIPTION OF THE DRAWINGS

One or more embodiments of the disclosed techniques are illustrated by way of example and not limitation in the figures of the accompanying drawings, in which like references indicate similar elements.

DETAILED DESCRIPTION

Disclosed here is a preconfigured planar container template ("container template") that can be assembled into a triangular shipping container ("container"). The container template is a substantially planar panel/flat sheet having a specified number of fold lines at specified positions in the planar panel, which can be assembled into the container by folding at the fold lines. While not only assembling the container template into the container is very easy, making or manufacturing the container template is also very easy. The manufacturing of the container template can include cutting a planar panel, e.g., made of a preferable material, into a container template of a specified shape and size, and forming a specified number of fold lines on the container template. The container template can be manufactured without using any securing products, such as glue or staples.

The triangular shaped container is advantageous over other known containers, e.g., tube containers, in many ways. For example, the triangular shaped results in reduced storage costs as the container can be stored as unassembled flat sheet, which consumes less space compared to a cylindrical/tube container. In another example, storing the container as an unassembled flat sheet is more convenient than storing the tube container as tube containers can tend to roll away and therefore, are more prone to accidental damages. In yet another example, the transportation of the container is more convenient compared to a tube container as the tube container can tend to roll away on the conveyors.

The triangular shaped container is also advantageous over known containers. The known container templates make use of securing products like glue or staples, thereby making the manufacturing process more expensive and slow. However, such securing products are not needed for making the disclosed container template and therefore, by omitting the need for such securing products, the manufacturing of the disclosed container template is made cheaper, and faster.

The container can be used for shipping various items, e.g., posters, paintings, other art items, or any item that can be rolled and/or fit into the container.

A preferred material for the container template can be cardboard. The material can also be other heavy-duty paper of various strengths, ranging from a simple arrangement of a single thick sheet of paper to complex configurations featuring multiple corrugated and uncorrugated layers. In some embodiments, the container template can be made of plastic. But based on the purpose of the use, any desired material can be used. Some of the fold lines can be perforated as well, e.g., to make the folding of the container template more easy. The perforations in the perforated lines can be of any size or shape. In some embodiments, any other technique that helps in folding can replace or be used in addition to perforation.

Figure 1:
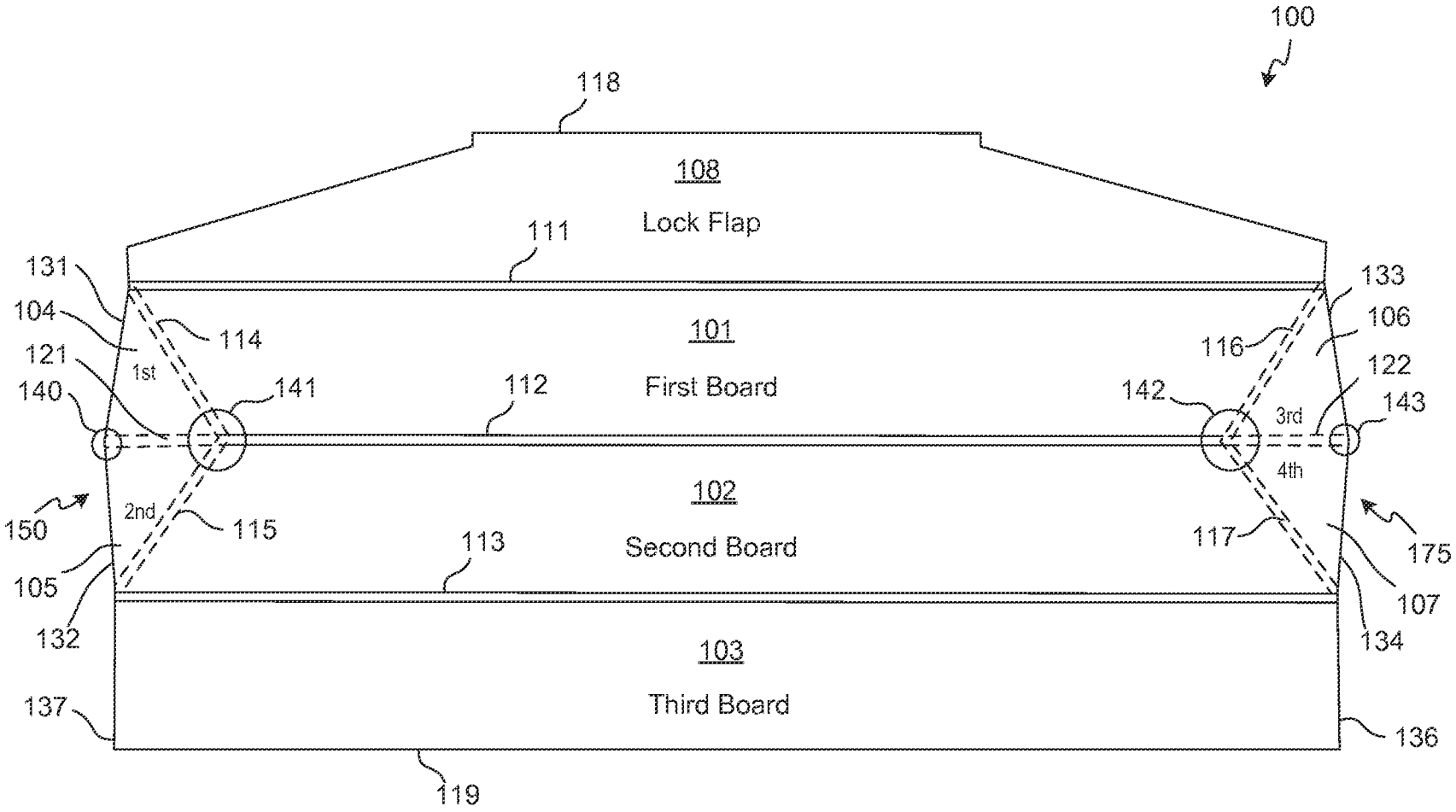
FIG. 1 is a front view of a first configuration of a container template that is configured to be assembled into a triangular shaped container, consistent with various embodiments.

Turning now to the figures, FIG. 1 is a front view of a first configuration of a container template that is designed to be assembled into a triangular shaped container, consistent with various embodiments. In some embodiments, a container template 100 is a single substantially flat sheet that includes a number of fold lines of different dimensions at different positions. These fold lines result in dividing the container template 100 into various sections (also referred to as "boards" or "panels") that are foldably interconnected. The sections of the container template 100 when folded along the fold lines form a container.

The container template 100 includes three boards 101-103 and a lock flap 108. The front view illustrated in FIG. 1 is of the interior surface of the container template 100. A first board 101 consists of four sides, e.g., as a first side 111, a second side 131, a third side 112, and a fourth side 133. The second board 102 consists of four sides, e.g., a first side 112, a second side 132, a third side 113, and a fourth side 134. A third board 103 consists of four sides, e.g., a first side 113, a second side 137, a third side 119, and a fourth side 136. The lock flap 108 includes a first edge 118 and a second edge 111.

Note that the lock flap 108 and the first board 101 are foldably connected to each other along their common side, e.g., side 111, which is referred to as a first fold line 111. Similarly, the first board 101 and the second board 102 are foldably connected to each other along their common long edge, e.g., side 112, which is referred to as a second fold line 112. Similarly, the second board 102 and the third board 103 are foldably connected to each other along their common long edge, e.g., side 113, which is referred to as a third fold line 113.

The container template 100 includes two wings flaps, a first wing flap 150 and a second wing flap 175, that form side walls of the container when the container template 100 is folded to form the container. The first wing flap 150 is located near a first end 140 of the second fold line 112, and the second wing flap 175 is located near the second end 143 that is opposite to the first 140 of the second fold line 112.

Figure 2A:
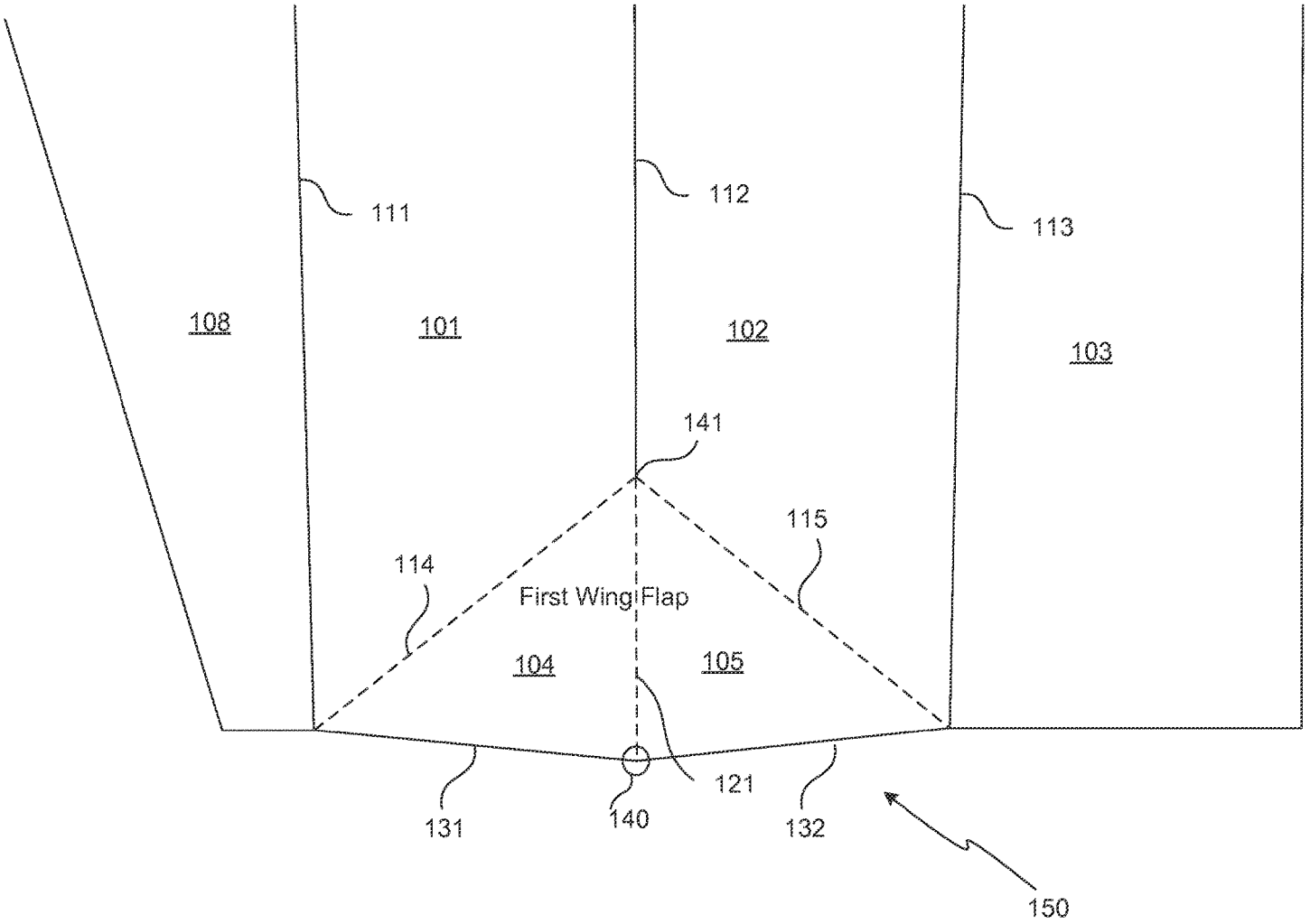
FIG. 2A is a view of a first wing flap of the container template of FIG. 1, consistent with various embodiments.

The first wing flap 150 includes a first section 104 of the first board 101 and a second section 105 of the second board 102. In some embodiments, the first and second sections 104 and 105 are triangular in shape. The first section 104 is enclosed by three sides—a first side 114, a second side 121 and a third side which is the same as side 131 of the first board 101 or a segment of it. The first side 114 extends from the side 131, e.g., at the intersection of the first fold line 111 and the side 131, to the second fold line 112 intersecting the second fold line 112 at a first vertex 141. Similarly, the second section 105 is enclosed by three sides—a first side 115, a second side 121 and a third side which is the same as side 132 of the second board 102 or a portion of it. The first side 115 extends from the side 132, e.g., at the intersection of the third fold line 113 and the side 132, to the second fold line 112 intersecting the second fold line 112 at the first vertex 141. Note that the side 114 of the first section 104 and the side 115 of the second section 105 intersect the second fold line 112 at the same specified angle. Also, note that the side 121 is common to both the sections 104 and 105. Further, the side 121 is a segment of the second fold line 112 that extends from the first end 140 of the second fold line 112 to the first vertex 141. In some embodiments, the first section 104 and the second section 105 are symmetric about the side 121. In some embodiments, the sides of the sections 104 and 105, e.g., sides 114, 115 and 121 are perforated to facilitate easy folding. FIG. 2A is a block diagram of another view of the first wing flap 150, consistent with various embodiments.

Figure 2B:
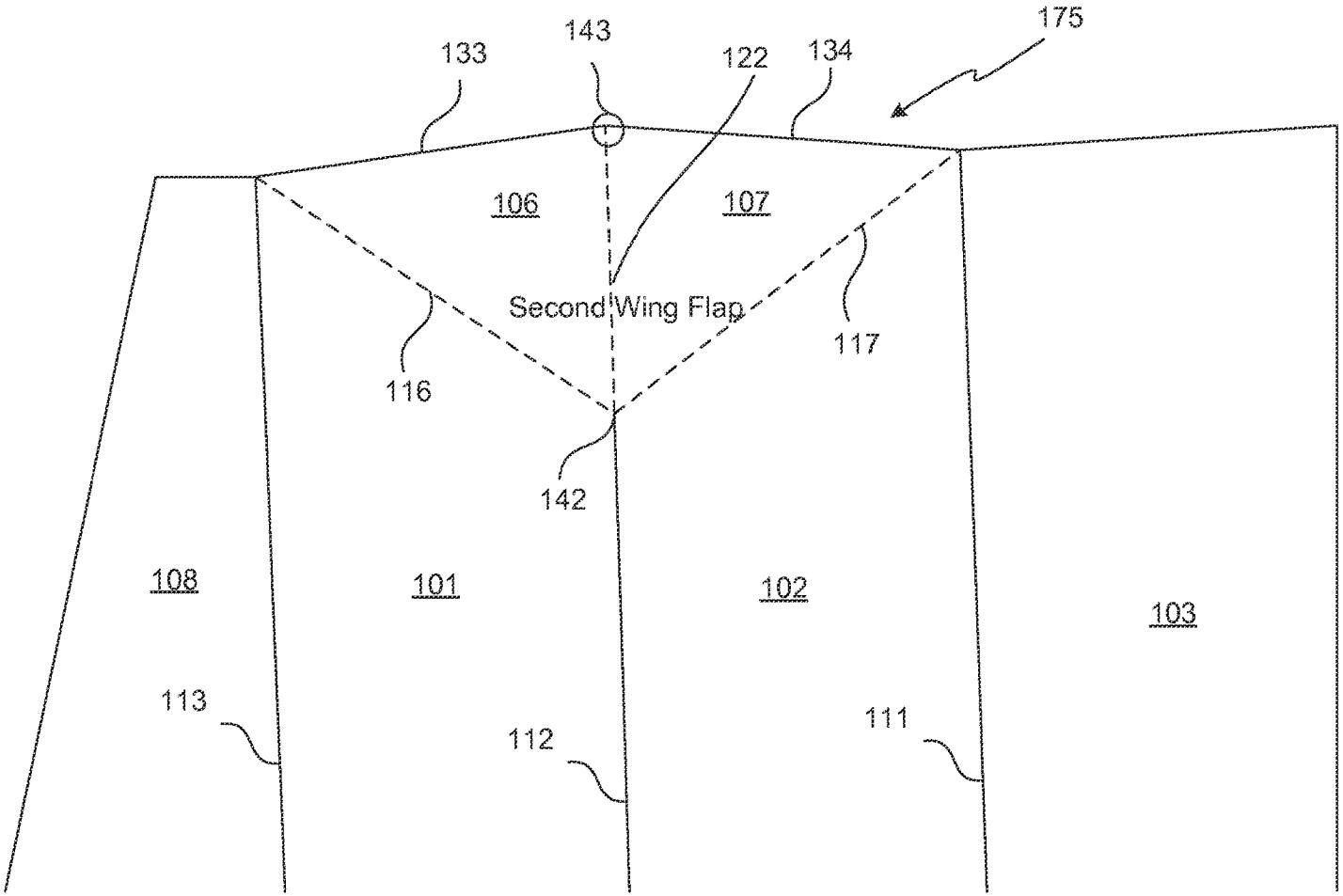
FIG. 2B is a view of a second wing flap of the container template of FIG. 1, consistent with various embodiments.

The second wing flap 175 is constructed similar to the first wing flap 150. The second wing flap 175 includes two sections, e.g., a third section 106 and a fourth section 107, which can be triangular in shape. The third section 106 includes a side 116 that extends from the side 133, e.g., at the intersection of the first fold line 111 and the side 133, to the second fold line 112 intersecting the second fold line 112 at a second vertex 142. Similarly, the fourth section 107 includes a side 117 that extends from the side 134, e.g., at the intersection of the third fold line 113 and the side 134, to the second fold line 112 intersecting the second fold line 112 at the second vertex 142. The sections 106 and 107 have a common side 122, which is a segment of the second fold line 112 that extends from the second end 143 of the second fold line 112 to a second vertex 142. In some embodiments, the third section 106 and the fourth section 107 are symmetric about the side 122. In some embodiments, the sides of the sections 106 and 107, e.g., sides 116, 117 and 122 are perforated to facilitate easy folding. FIG. 2B is a block diagram of another view of the second wing flap 175, consistent with various embodiments.

In order to assemble the container template 100 into the container, some or all of the foldable sides, e.g., the first fold line 111, the second fold line 112, the third fold line 113, sides 114-117, side 121 and side 122, can be folded. For example, the first wing flap 150 and the second wing flap 175 can be folded at the first vertex 141 and the second vertex 142, respectively, towards each other such that the first end 140 and the second end 143 move towards each other (see, for example, FIG. 3A). By doing so, the first board 101 and the second board 102 fold along the second fold line 112 toward each other (see, for example, FIG. 3A), e.g., the sides 111 and 113 move towards each other. The third board 103 can then be folded along the third fold line 113 towards the first fold line 111 (see, for example, FIG. 3B). Then the lock flap 108 can be folded along the first fold line 111 towards the third fold line over the third board to form an enclosed container 350 (see, for example, FIGS. 3C and 3D). Further, for the lock flap 108 to remain in the enclosed position, the lock flap 108 can be secured to the third board 103 using securing means such as a tape.

In some embodiments, the first board 101 and the second board 102 are trapezoidal in shape. The trapezoidal shape can enable side walls of the container 350, which are formed from sections 104, 105, 106 and 107 when the container template 100 is folded, to be strong and sturdy. However, in other embodiments, the two boards can be of other shapes as long as they provide the required strength to the side walls of the container 350. In some embodiments, the first board 101 and the second board 102 are of substantially the same dimension. In some embodiments, two entities are considered to be of substantially the same dimension if one or more of their dimensions differ by a specified percentage, e.g., 5%-10%. The specified percentage can be a value that is determined based on industry standards. In some embodiments, the first board 101 and the second board 102 are symmetric about the second fold line 112. The third board 103 can be rectangular in shape.

In some embodiments, the lock flap 108 is trapezoidal in shape. However, other configurations of the lock flap 108 are also possible. For example, the lock flap 108 can be of an arch shape. In another example, the lock flap 108 can be split into two or more lock flaps. In some embodiments, the area of the lock flap 108 is lesser than that of the board, e.g., the third board 103, over which the lock flap 108 folds. In some embodiments, having the area of the lock flap 108 lesser than the board over which it folds, enables the lock flap 108 to be opened or closed easily and also to be secured to the board in the enclosed position, e.g., by using a tape.

Figure 3A:
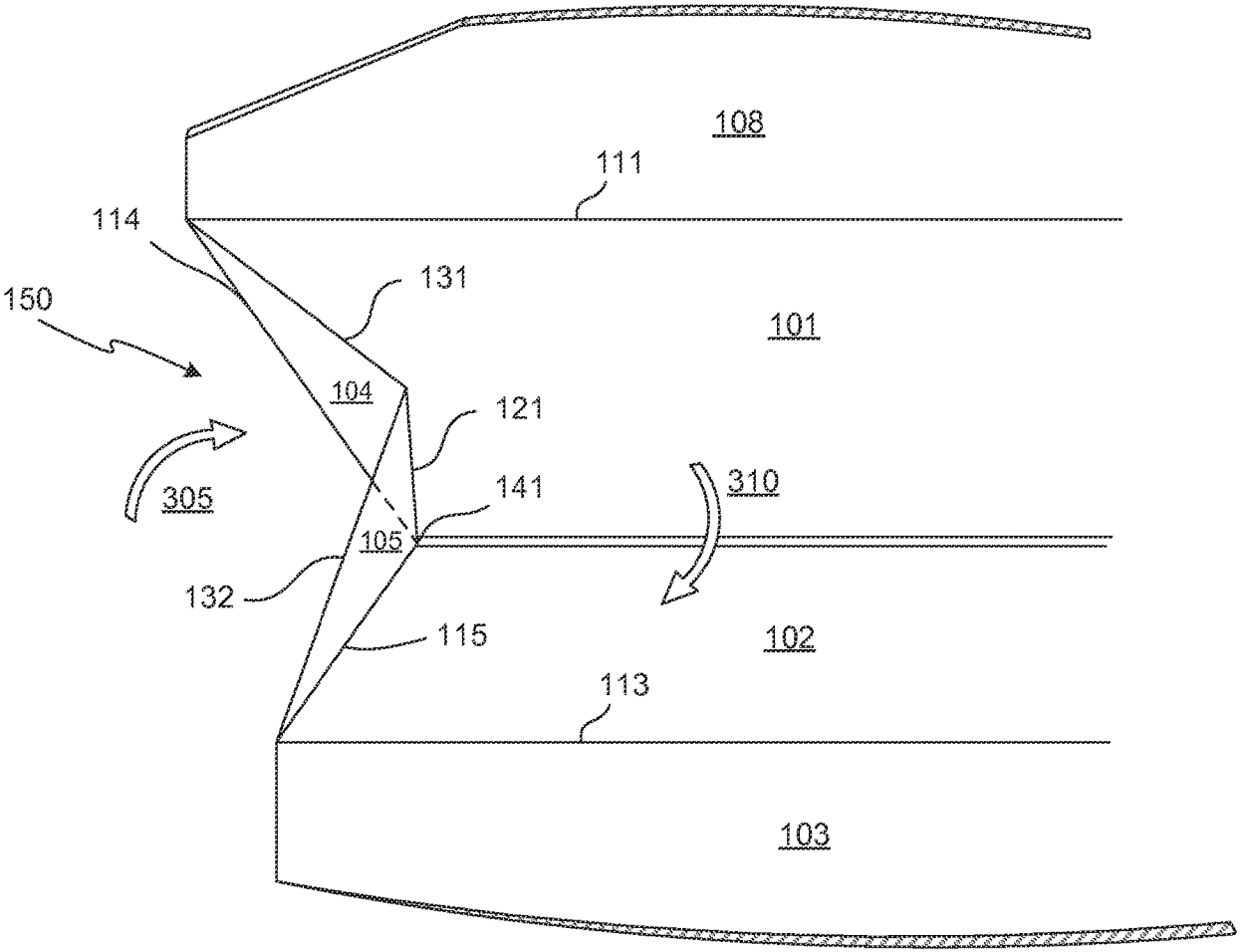
FIG. 3A is a partial view of the container template of FIG. 1 illustrating folding a first wing flap of the container template, consistent with various embodiments.

FIG. 3A is a partial view of the container template of FIG. 1 illustrating folding a first wing flap of the container template, consistent with various embodiments. As illustrated, the first wing flap 150 is configured to be folded at the sides 114, 115 and 121. The first arrow 305 indicates the direction in which the first wing flap 150 is to be folded. Similarly, the second wing flap 175 is configured to be folded at sides 116, 117, and 122 (not illustrated in FIG. 3A). The second arrow 310 indicates the direction in which the first board 101 and the second board 102 fold towards each other. In some embodiments, when the first wing flap 150 and the second wing flap 175 are folded at the first vertex 141 and the second vertex 142, respectively, the sides 121 and 122 have a near perpendicular position to the second foldable line 112. In some embodiments, the sides of the sections 104-107, e.g., sides 114-117, 121 and 122 are perforated to facilitate easy folding. However, means other than perforation can be incorporated to enable easy folding. Further, the perforations for different sides can be of different types and/or sizes.

Figure 3B:
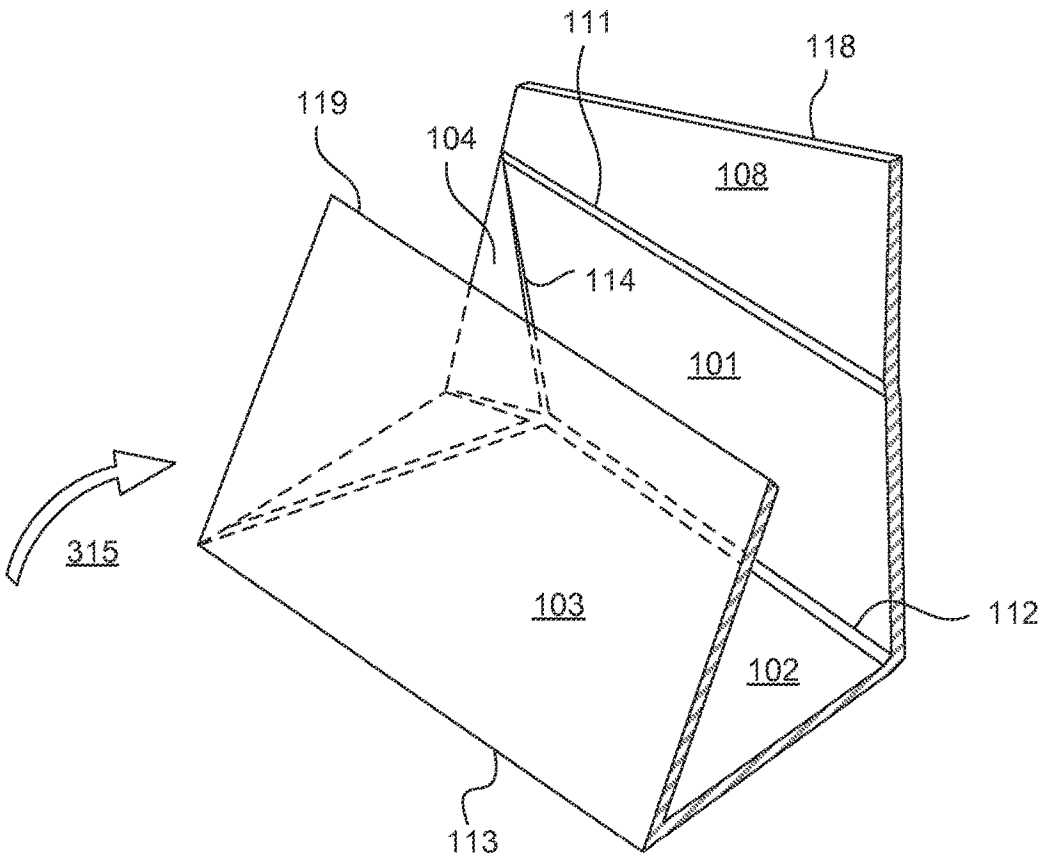
FIG. 3B is a partial view of the container template of FIG. 1 illustrating folding a third board of the container template, consistent with various embodiments.

FIG. 3B is a partial view of the container template 100 illustrating folding the third board, consistent with various embodiments. As illustrated, the third board 103 is configured to be folded along the third fold line 113 in the direction indicated by a third arrow 315 such that the side 119 moves towards the first fold line 111. In some embodiments, the third board 103 should preferably touch the first fold line 111 to form the triangular shaped container 350.

Figure 3C:
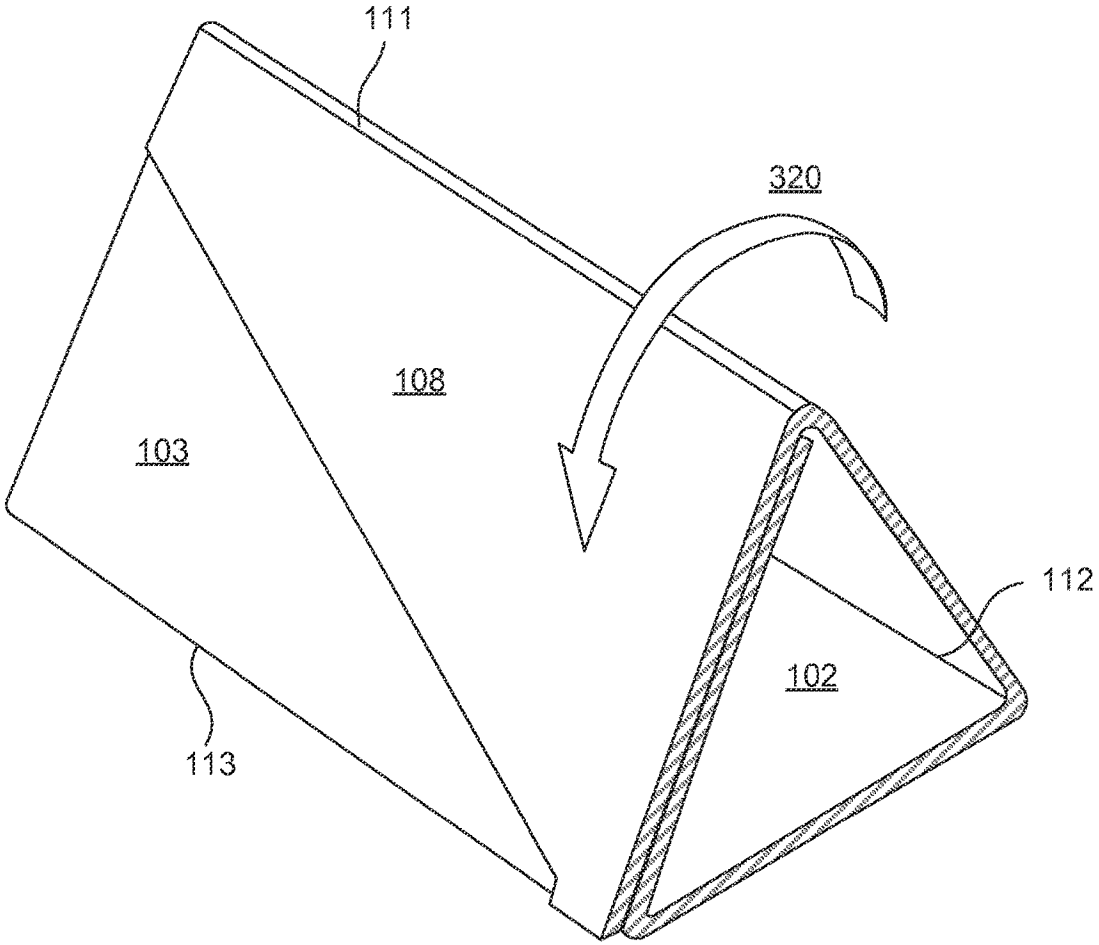
FIG. 3C is a view of a cross section of the container of FIG. 2C in an enclosed state, consistent with various embodiments.
Figure 3D:
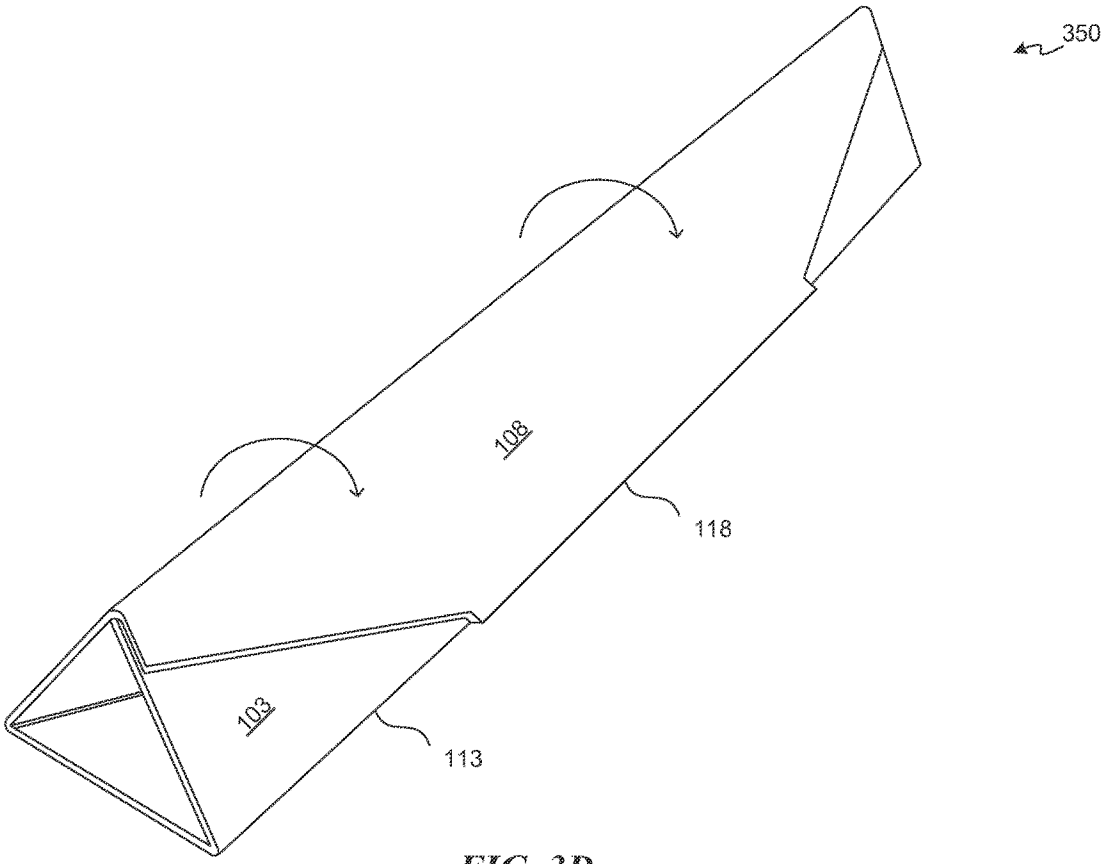
FIG. 3D is a view of a container formed by assembling the container template of FIG. 1, consistent with various embodiments.

FIG. 3C is a view of a cross section of a container 350 formed by assembling the container template 100, consistent with various embodiments. As illustrated, the lock flap 108 is folded over the third board 103 in a direction indicated by the fourth arrow 320 to enclose and/or secure the container 350. FIG. 3D is another view of the container 350 in the enclosed state, consistent with various embodiments.

Figure 4A:
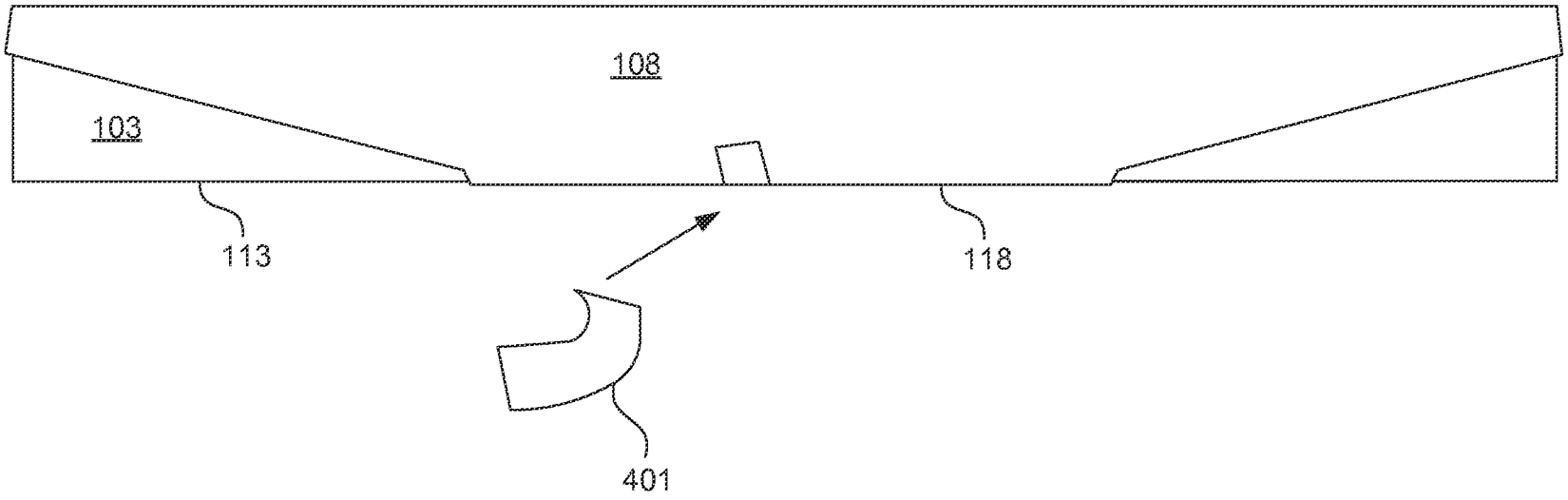
FIG. 4A is a view of the container of FIG. 2C with a lock flap in the secured position, consistent with various embodiments.
Figure 4B:
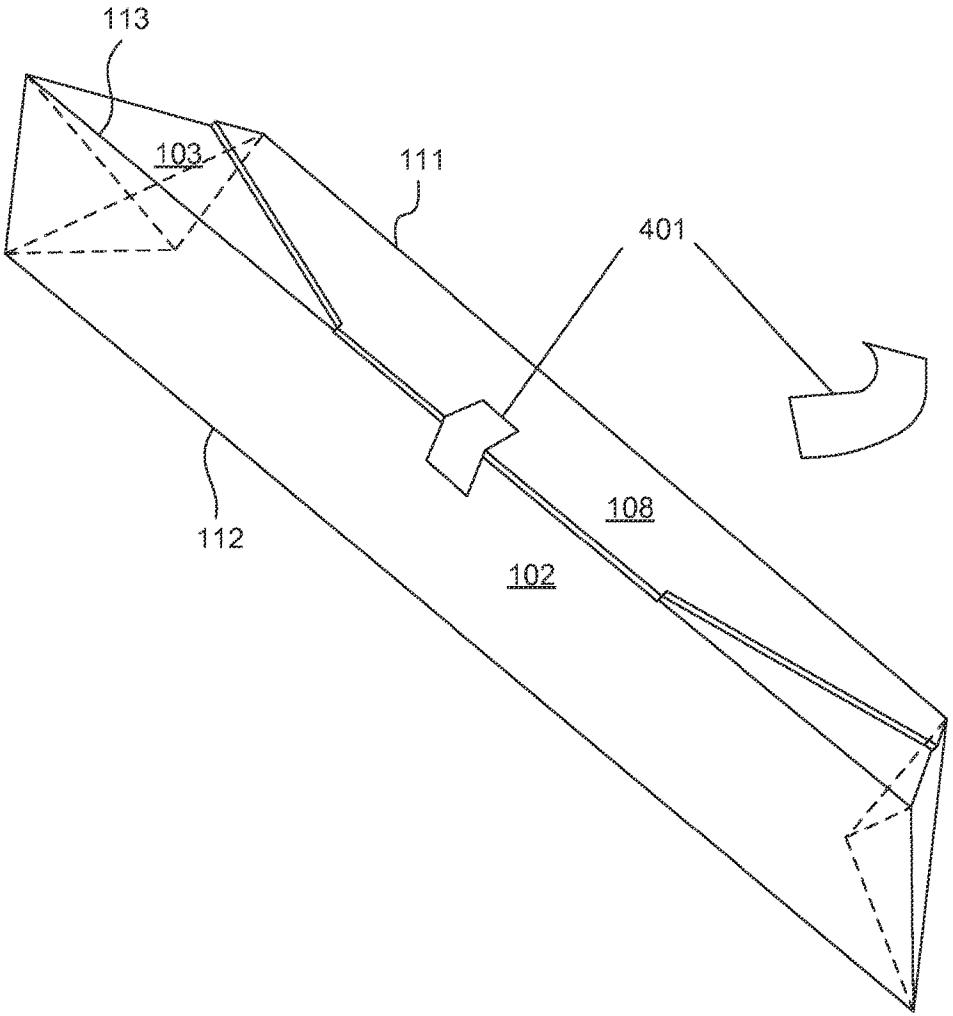
FIG. 4B is another view of the container illustrated in FIG. 4A with a lock flap in the secured position, consistent with various embodiments.

Further, for the lock flap 108 to remain in the enclosed position, the lock flap 108 can be secured to the third board 103 using securing means such as a tape 401 as illustrated in FIG. 4A. FIG. 4B is another view of the container 350 with the lock flap 108 in the secured position, consistent with various embodiments.

Figure 5:
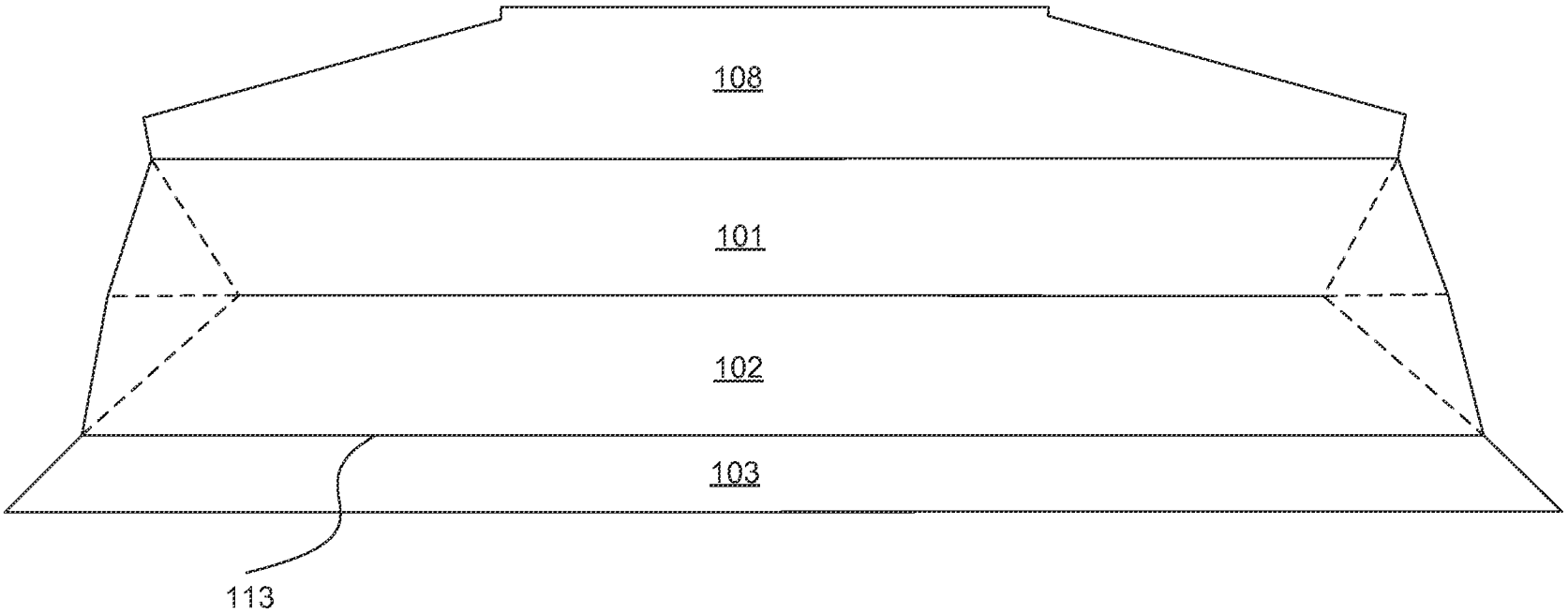
FIG. 5 is another view of the first configuration of the container template of FIG. 1 partially folded at a fold line connecting a second board and a third board of the container template, consistent with various embodiments.

FIG. 5 is another view of the first configuration of the container template 100 partially folded at the third fold line 113 connecting the second board 102 and the third board 103 of the container template 100, consistent with various embodiments.

Figure 6:
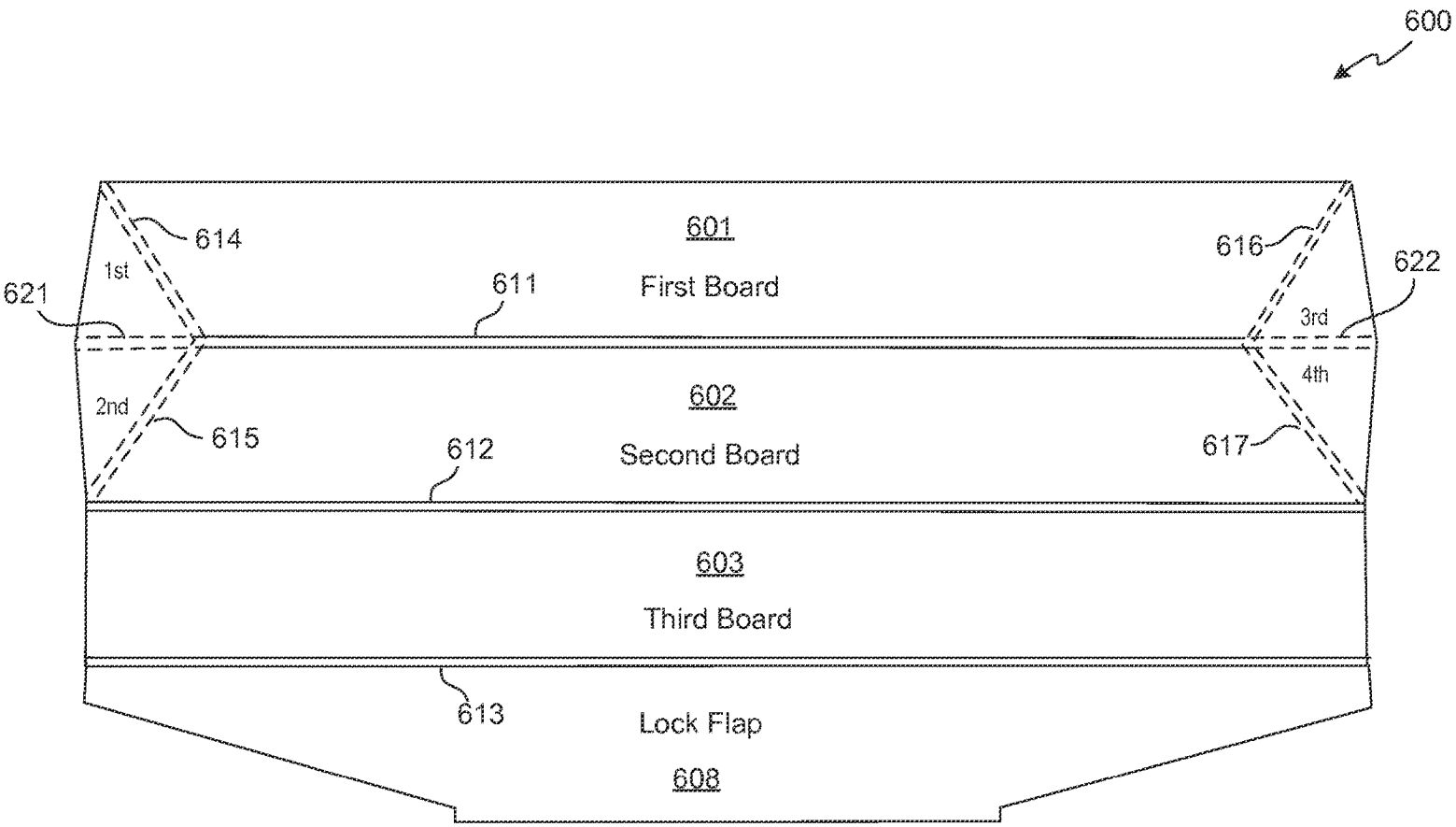
FIG. 6 is a front view of a second configuration of a container template that is configured to be assembled into a triangular shaped container, consistent with various embodiments.

FIG. 6 is a front view of a second configuration of a container template 600 that is configured to be assembled into a triangular shaped container, consistent with various embodiments. In some embodiments, the container template 600 is similar to the container template 100 of FIG. 1. However, in the container template 600, the lock flap 608 is foldably connected to the third board 603 as opposed to the first board 601 as in the container template 100. In the container template 600, the first board 601 is foldably connected to the second board 602 along a first fold line 611, the second board 602 foldably is connected to the third board 603 along a second fold line 612 and the lock flap 608 is foldably connected to the third board 603 along the third fold line 613. In this second configuration, when the container template 600 is folded along the fold lines, e.g., fold lines 611-617, 621 and 622, to form a container, the lock flap 608 folds over the outer surface of the first board 601.

Figure 7:
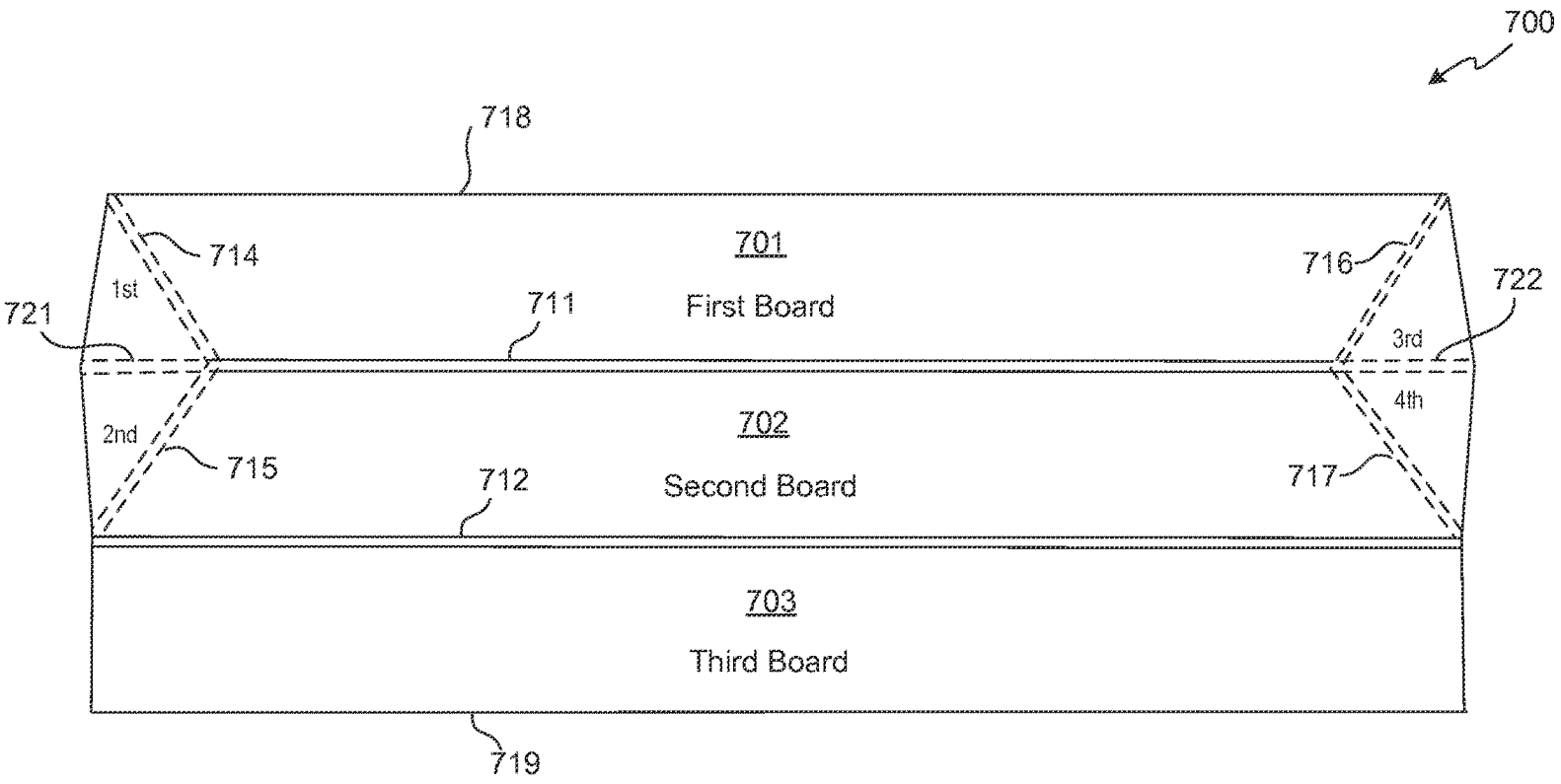
FIG. 7 is a front view of a third configuration of a container template that is configured to be assembled into a triangular shaped container, consistent with various embodiments.
Figure 8:
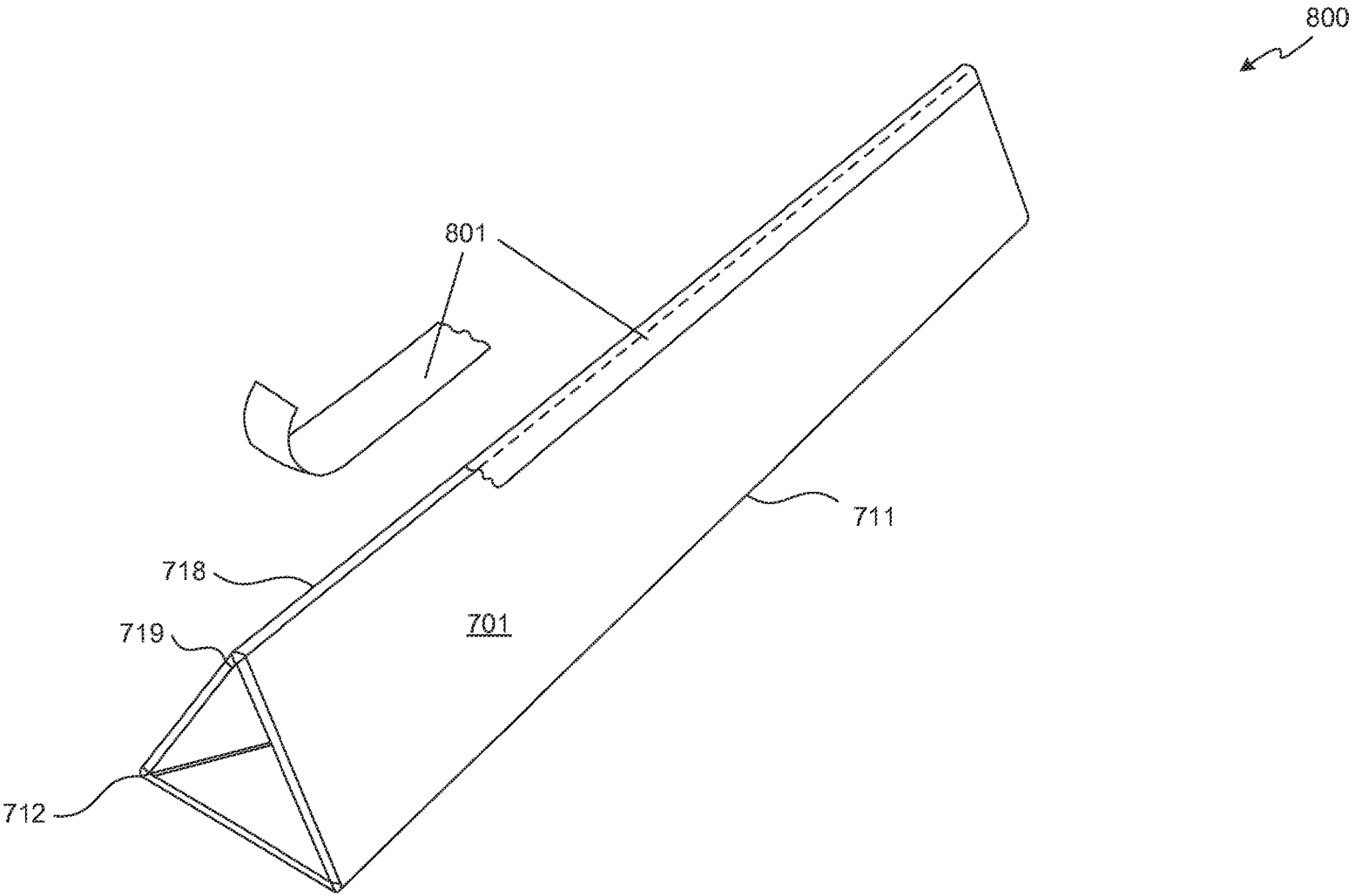
FIG. 8 is a view of a container assembled from the container template of FIG. 7, consistent with various embodiments.

FIG. 7 is a front view of a third configuration of a container template 700 that is configured to be assembled into a triangular shaped container, consistent with various embodiments. In some embodiments, the container template 700 is similar to the container template 100 of FIG. 1. However, the container template 700 does not include a lock flap. The container template 700 can be folded, e.g., along fold lines 711, 712, 714-717, 721 and 722 to form a container 800, e.g., as illustrated in FIG. 8, without the lock flap. The container 800 can be held in the enclosed position by securing means, such as a tape 801. In some embodiments, the tape 801 can be applied over the first board 701 and the third board 703 along the sides 718 and 719, as illustrated in FIG. 8.

Referring back to the container template 100 of FIG. 1, in some embodiments, the container template 100 can have non-trapezoidal panel for any of the first, second, or the third boards 101-103. For example, one or more of the edges 119, 136 and 137 of the third board 103 can be a curved or an arch shaped edge. The arch shaped edge can be of an aesthetic or functional value to the user, e.g., create an access for easy investigation of the objects inside the container without opening/unassembling the container. Furthermore, the manufacturer can aesthetically design the edges 119, 136 and 137 to look like logos, names, etc. In another example, the container template 100 can have holes along one or more of the fold lines 111-113. Such holes might have aesthetic or functional value to the user, e.g., create an access for easy investigation of the objects inside the container without opening/unassembling the container.

In another example, the lock flap 108 can also be of various shapes. The lock flap 108 can cover the third board 103 partially or completely. In some embodiments, the area of one or more of the boards 101-103, including the lock flap, is large enough to leave room for labeling, tagging, advertising, branding, etc.

In some embodiments, the container 350 and/or 800 can be used for shipping items such as art items, including posters, paintings, pictures, and other items that can be rolled and/or fit into the container. Further, the container 350 and/or 800 can be manufactured in various sizes.

In some embodiments, the method of manufacturing the container template 300 can include cutting the planar panel into a specified shape with specified dimensions, e.g., like the shape of the container template 100. After the planar panel is cut into the specified shape and dimensions, fold lines such as fold lines 111-113 and 114-117 are formed on the planar panel. Further, as an optional step, one or more of the fold lines, e.g., fold lines 114-117, can be designed in one or more ways, e.g., perforated, to provide different folding characteristics from that of the remaining fold lines.

Although the present invention has been described with reference to specific exemplary embodiments, it will be recognized that the invention is not limited to the embodiments described, but can be practiced with modification and alteration within the spirit and scope of the embodiments described. Accordingly, the specification and drawings are to be regarded in an illustrative sense rather than a restrictive sense.

We claim:

1. A planar container template to be assembled into a container, comprising:

a first trapezoidal board;

a second trapezoidal board, the second trapezoidal board and the first trapezoidal board foldably connected to each other along a common long edge, the common long edge being a common edge between the first trapezoidal board and the second trapezoidal board, and having a first end and a second end opposite to the first end, wherein a first edge of the first trapezoidal board and a second edge of the second trapezoidal board intersect at the first end of the common long edge, wherein the first edge and the second edge are non-linear edges;

a third board foldably connected to the second trapezoidal board;

a first foldable wing flap near the first end, the first foldable wing flap including a first triangular portion of the first trapezoidal board and a second triangular portion of the second trapezoidal board that are foldably connected to each other along a first portion of the common long edge, the first triangular portion including a first side along which the first triangular portion is foldable, the second triangular portion including a second side along which the second triangular portion is foldable, the first side and the second side forming a first vertex on the common long edge;

a second foldable wing flap near the second end, the second foldable wing flap including a third triangular portion of the first trapezoidal board and a fourth triangular portion of the second trapezoidal board that are foldably connected to each other along a second portion of the common long edge, the third triangular portion including a third side along which the third triangular portion is foldable, the fourth triangular portion including a fourth side along which the fourth triangular portion is foldable, the third side and the fourth side forming a second vertex on the common long edge, wherein, when the first trapezoidal board, the second trapezoidal board and the third board are folded, the planar assembly is configured to form the container, and wherein, when the first trapezoidal board and the second trapezoidal board are folded along the common long edge, the first foldable wing flap and the second foldable wing flap are configured to fold at the first vertex and the second vertex, respectively, with:

the first end and the second end folding towards each other, and the first portion of the common long edge being nearly perpendicular to the common long edge, wherein the first side, the second side and the first portion of the common long edge are perforated to enable folding, and wherein at least two of the first side, the second side and the first portion of the common long edge within the planar container template are perforated with different sizes of perforations.

2. The planar container template of claim 1, wherein, when the first trapezoidal board and the second trapezoidal board are folded along the common long edge, the first foldable wing flap is further configured to fold along the first side, the second side and the first portion of the common long edge.

3. The planar container template of claim 1, wherein, when the first trapezoidal board and the second trapezoidal board are folded along the common long edge, the second foldable wing flap is further configured to fold along the third side, the fourth side and the second portion of the common long edge.

4. The planar container template of claim 1, wherein the second trapezoidal board and the first trapezoidal board are symmetric about the common long edge.

5. The planar container template of claim 1 further comprising:

a lock flap, the lock flap foldably connected to the third board and along a first edge of the third board that is opposite to an edge connected to the second board, the lock flap configured to fold over the first trapezoidal board to cause the container to be enclosed.

6. The planar container template of claim 1 further comprising:

a lock flap, the lock flap foldably connected to the first trapezoidal board and along a first edge of the first trapezoidal board that is opposite to the common long edge, the lock flap configured to fold over the third board to cause the container to be enclosed.

7. The planar container template of claim 6, wherein the lock flap has an area lesser than that of the first trapezoidal board or the third trapezoidal board.

8. The planar container template of claim 1, wherein the first side of the first triangular portion and the second side of the second triangular portion are configured to intersect at the first vertex at the same angle relative to the common long edge.

9. A triangular shipping container that is a flat surface when unassembled, comprising:

a first board;

a second board that is foldably connected to the first board along a first fold line, wherein a first edge of the first board and a second edge of the second board intersect at a first end of the first fold line, wherein the first edge and the second edge are non-linear edges;

a third board that is foldably connected to the second board along a second fold line;

a first foldable wing flap near the first end of the first fold line, the first foldable wing flap including a first portion of the first board and a second portion of the second board, the first portion and the second portion being symmetric about the first fold line; and a second foldable wing flap near a second end of the first fold line, the second end being opposite to the first end, the second foldable wing flap including a third portion that is formed from the first board and a fourth portion that is formed from the second board, the third portion and the fourth portion being symmetric about the first fold line, wherein when the flat surface is folded at the first fold line and the second fold line:

at least two of the first board, the second board and the third board fold at the first fold line and the second fold line to form the triangular shipping container.

10. The triangular shipping container of claim 9, wherein when the flat surface is folded at the first fold line and the second fold line, the first foldable wing and the second foldable wing fold into the triangular shipping container and towards each other to form some of multiple walls of the triangular shipping container.

11. The triangular shipping container of claim 9, wherein the second fold line is parallel to the first fold line.

12. The triangular shipping container of claim 9, wherein the first wing flap and the second wing flap are configured to fold at a first vertex and a second vertex on the first fold line, respectively.

13. The triangular shipping container of claim 9, wherein the first portion and the second portion of the first wing flap share a foldable side, the foldable side being a portion of the first foldable line.

14. The triangular shipping container of claim 13, wherein the foldable side is a portion of the foldable line between the first vertex and the first end.

15. The triangular shipping container of claim 9, wherein the first portion and the second portion of the first wing flap are triangular in shape.

16. The triangular shipping container of claim 9, wherein the first portion and the second portion of the first wing flap include perforated edges.

17. The triangular shipping container of claim 9 further comprising:

a lock flap that is foldably connected to one of the first board or the third board along a third fold line, the third fold line being parallel to the second fold line when the triangular shipping container is unfolded to form the flat surface.

18. The triangular shipping container of claim 9 further comprising:

a lock flap that is foldably connected to one of the first board or the third board.

19. The triangular shipping container of claim 18, wherein, when the triangular shipping container is enclosed, the lock flap is configured to:

fold over the third board if the lock flap is connected to the first board or over the first board if the lock flap is connected to the third board.

20. A planar material to be assembled into a container, comprising:

a first trapezoidal portion;

a second trapezoidal portion foldably connected to the first trapezoidal portion at a first foldable line, wherein a first edge of the first trapezoidal portion and a second edge of the second trapezoidal portion intersect at a first end of the first foldable line, wherein the first edge and the second edge are non-linear edges;

a third portion foldably connected to the second trapezoidal portion at a second foldable line, wherein an edge of the third portion opposite to the second foldable line is a curved edge, the planar material including:

a first pair of perforated lines converging at the first foldable line forming a first vertex near the first end of the first foldable line, wherein a first perforated line of the first pair of perforated lines is extending from a first point on the first edge of the first trapezoidal portion, wherein a second perforated line of the first pair of perforated lines is extending from a second point on the second edge of the second trapezoidal portion, wherein the first pair of perforated lines form a pair of triangular shaped portions, the pair of triangular shaped portions sharing a portion of the first foldable line as a common side, and a second pair of perforated lines converging at the first foldable line forming a second vertex near a second end of the first foldable line, the second end being opposite to the first end, wherein the planar material is configured to form the container when folded at the first foldable line, the second foldable line, the first pair of perforated lines and the second pair of perforated lines.

21. The planar material of claim 20, wherein the pair of triangular shaped portions are symmetric about their common side.

22. A method for making a planar material that is configured to be assembled into a container, the method comprising:

forming, in the planar material, a first trapezoidal portion, a second trapezoidal portion and a third portion;

forming, in the planar material, a first foldable line that foldably connects the first trapezoidal portion and the second trapezoidal portion, and a second foldable line that foldably connects the second trapezoidal portion and the third portion, wherein a first edge of the first trapezoidal portion and a second edge of the second trapezoidal portion intersect at a first end of the first foldable line, wherein the first edge and the second edge are non-linear edges;

forming, in the planar material, a first pair of perforated lines that converge at the first foldable line forming a first vertex near the first end of the first foldable line, wherein a first perforated line of the first pair of perforated lines extends from a first point on the first edge of the first trapezoidal portion, wherein a second perforated line of the first pair of perforated lines extends from a second point on the second edge of the second trapezoidal portion, wherein the first pair of perforated lines form a pair of triangular shaped portions on the first trapezoidal portion, the pair of triangular shaped portions sharing a portion of the first foldable line as a common side; and forming, in the planar material, a second pair of perforated lines converging at the first foldable line forming a second vertex near a second end of the first foldable line, the second end being opposite to the first end, wherein the planar material is configured to form the container when folded at the first foldable line, the second foldable line, the first pair of perforated lines and the second pair of perforated lines.

* * * * *